US008702198B2

(12) United States Patent
Davison et al.

(10) Patent No.: US 8,702,198 B2
(45) Date of Patent: Apr. 22, 2014

(54) IMAGE FORMING APPARATUS AND METHODS THEREOF

(75) Inventors: Justin Davison, San Diego, CA (US); Brian D Gragg, San Diego, CA (US); Robert Lockwood, San Diego, CA (US); Alejandro Campillo, Encinitas, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 281 days.

(21) Appl. No.: 13/096,631

(22) Filed: Apr. 28, 2011

(65) Prior Publication Data

US 2012/0274692 A1 Nov. 1, 2012

(51) Int. Cl.
*B41J 2/165* (2006.01)

(52) U.S. Cl.
USPC ..... 347/22; 347/33; 347/36

(58) Field of Classification Search
USPC ..... 347/21–23, 29, 33–36
See application file for complete search history.

(56) References Cited

U.S. PATENT DOCUMENTS 6,644,778 B2 11/2003 Rotering
6,837,636 B2 * 1/2005 Sawyer et al. ..... 400/692
7,712,862 B1 5/2010 Campillo et al.

* cited by examiner

*Primary Examiner* — Julian Huffman
*Assistant Examiner* — Sharon A Polk

(57) ABSTRACT

A method of detecting fluid drops ejected from a fluid applicator unit having nozzles. The method includes establishing a detection zone to detect detection fluid drops transmitted therein and ejecting a set of detection fluid drops through a set of nozzles of the fluid applicator unit through the detection zone to a detection receiving member. The method also includes ejecting a set of warm-up fluid drops through an other set of nozzles to a warm-up receiving member in a manner in which the set of warm-up fluid drops bypasses the detection zone. The method also includes detecting the set of the detection fluid drops ejected into the detection zone.

16 Claims, 5 Drawing Sheets

IMAGE FORMING APPARATUS AND METHODS THEREOF

BACKGROUND

An image forming apparatus may include a drop detection unit and a fluid applicator unit such as an inkjet print head including a nozzle surface having nozzles thereon. The fluid applicator unit may eject the fluid such as ink through the nozzles and onto media. Periodically, the image forming apparatus may perform a maintenance routine to determine whether fluid is properly being ejected through respective nozzles. The maintenance routine may include the fluid applicator unit ejecting detection fluid drops through the respective nozzles into a detection zone to be detected by the drop detection unit.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
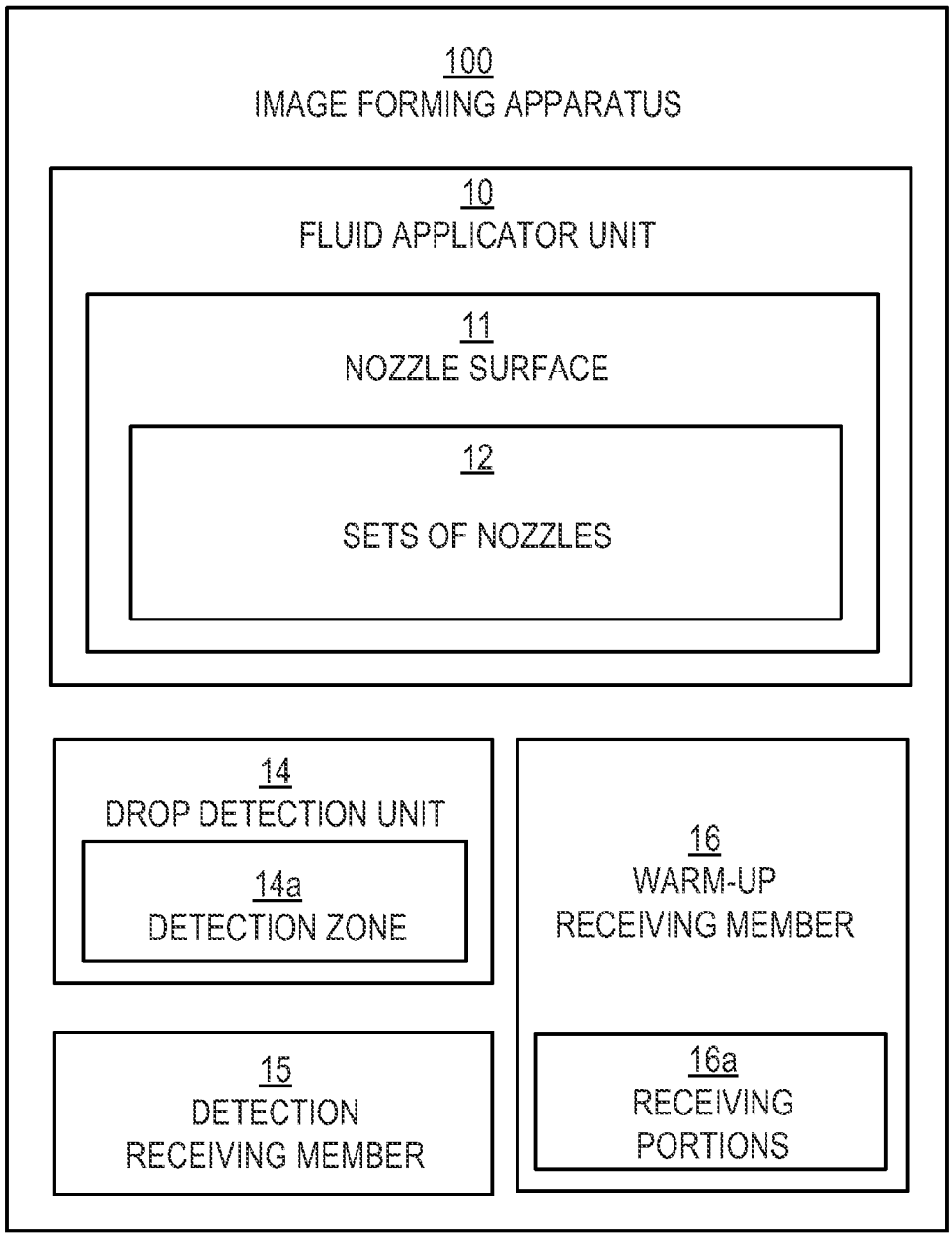
FIG. 1 is a block diagram illustrating an image forming apparatus according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

An image forming apparatus may include a fluid applicator unit including a nozzle surface such as a nozzle plate having nozzles disposed thereon, for example, to eject fluid therethrough to form images on media. The fluid applicator unit may eject fluid, for example, by using heat generated by a resistor, to cause the ejection of fluid through the nozzles to form fluid drops. On occasion, fluid may be prevented from being ejected through respective nozzles for a variety of reasons including obstructions formed in the respective nozzles. Such malfunctions may lead to image quality defects and component failures, if left undetected.

Accordingly, an image forming apparatus may also include a drop detection unit to establish a detection zone to detect fluid drops therein. The fluid application unit may periodically eject detection fluid drops through respective nozzles into the detection zone to confirm proper fluid ejection through the respective nozzles. Warm-up fluid drops may be ejected through the respective nozzles before detection fluid drops are ejected therethrough to ensure the detection fluid drops are representative of typical image forming fluid drops. Generally, however, the warm-up fluid drops are also ejected to pass into the detection zone and, thus, are ejected in series, rather than parallel, with the detection fluid drops for the drop detection unit to accurately detect the detection fluid drops. In addition, the detection fluid drops and the warm-up fluid drops may be received in proximately the same area which may lead to undesirable stalagmite formation and potentially interference with the detection zone and/or smudging of the nozzle surface of the fluid applicator unit. Thus, an execution time of the maintenance routine, manual stalagmite removal operations, and/or image quality defects may be increased.

In an example, a method includes, among other things, ejecting a set of detection fluid drops through a set of nozzles of the fluid applicator unit through the detection zone to a detection receiving member and ejecting a set of warm-up fluid drops through an other set of nozzles to a warm-up receiving member in a manner in which the set of warm-up fluid drops bypasses the detection zone. Further, both the set of warm-up fluid drops and the set of detection fluid drops are in flight at a same time during an overlapping time period. Thus, an execution time of the maintenance routine may be decreased. Also, in an example, a method includes, among other things, ejecting a set of detection fluid drops through a set of nozzles of the fluid applicator unit through the detection zone to a detection receiving member. The method also includes ejecting a plurality of sets of warm-up fluid drops through respective sets of nozzles of the fluid applicator unit to a warm-up receiving member. The second set of warm-up fluid drops bypasses the detection zone. Periodically, the receiving portions of the warm-up receiving member move in an advance direction. Thus, stalagmite formation, an amount of service, and/or image quality defects may be decreased.

FIG. 1 is a block diagram illustrating an image forming apparatus according to an example. Referring to FIG. 1, in the present example, the image forming apparatus 100 includes a fluid applicator unit 10, a drop detection unit 14, a detection receiving member 15, and a warm-up receiving member 16. The fluid application unit 10 includes a nozzle surface 11 having a plurality of sets of nozzles 12. The fluid applicator unit 10 is configured to eject sets of warm-up fluid drops through respective sets of nozzles 12*b* (FIG. 2) and to eject sets of detection fluid drops through respective sets of nozzles 12*a* (FIG. 2).

Referring to FIG. 1, the drop detection unit 14 is configured to establish a detection zone 14*a* and to detect respective sets of detection fluid drops such as a first set of detection fluid drops 23*c* (FIG. 2) transmitted therein. The detection receiving member 15 is configured to receive sets of detection fluid drops such as the first set of detection fluid drops 23*c*. The warm-up receiving member 16 includes a plurality of receiving portions 16*a*. The warm-up receiving member 16 may periodically move in an advance direction $d_a$ with respect to the nozzles. The warm-up receiving member 16 may be configured to receive the sets of warm-up fluid drops such that not all sets of warm-up fluid drops are received on a same receiving portion. The sets of detection fluid drops are ejected from the fluid applicator unit 10 to pass into the detection zone 14*a* and the respective sets of warm-up fluid drops including the first set of warm-up fluid drops 23*a* and the second set of warm-up fluid drops 23*b* are ejected by the fluid applicator unit 10 to bypass the detection zone 14*a*. A complete detection operation includes sequentially testing each of the sets of nozzles of the fluid applicator unit 10 through the use of detection fluid drops. In an example, the warm-up receiving member 16 may move in the advance direction $d_a$ with respect to the nozzles, for example, after a complete detection operation is completed.

Figure 2:
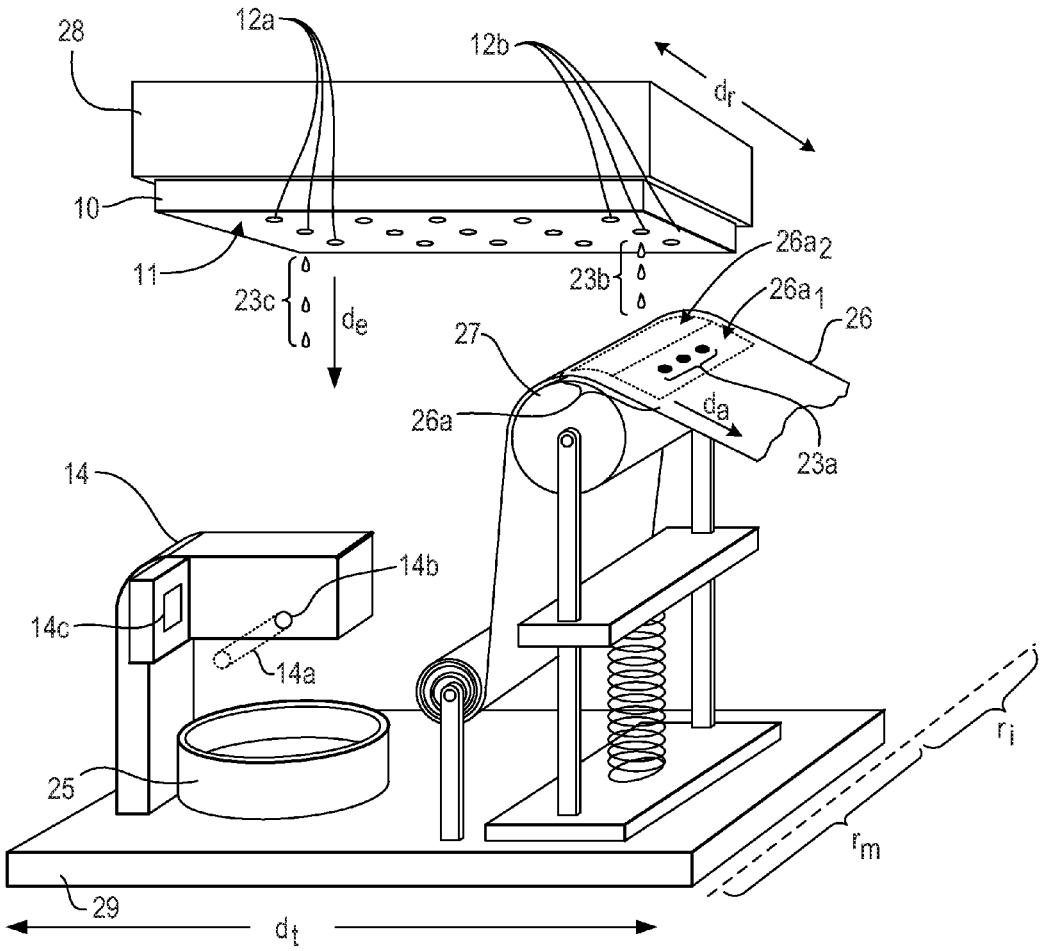
FIG. 2 is a perspective view illustrating the image forming apparatus of FIG. 1 according to example.
Figure 3A:
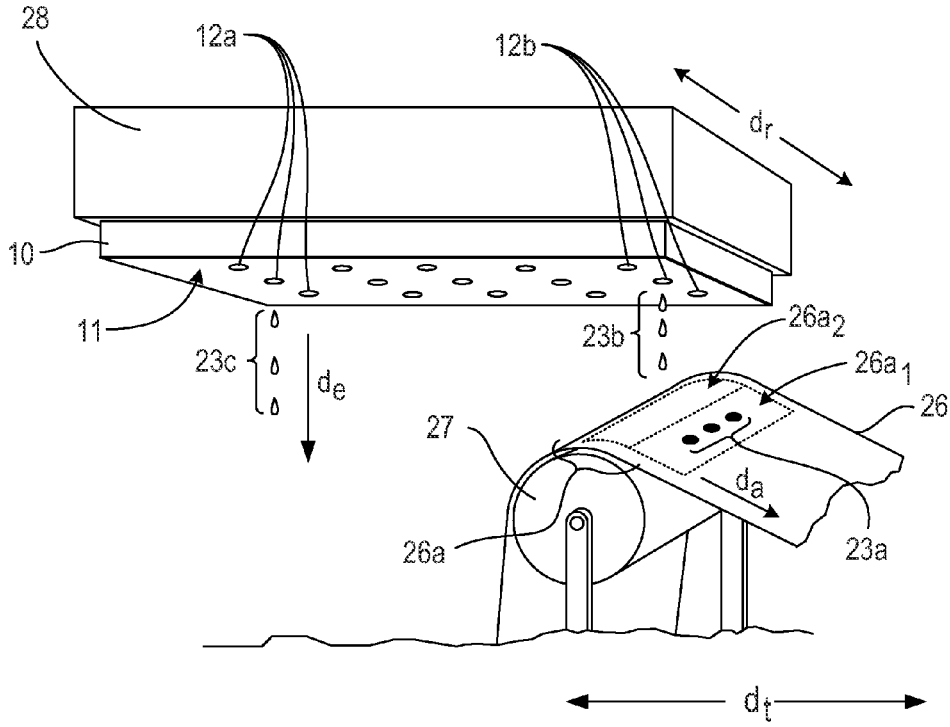
FIGS. 3A and 3B are side views illustrating portions of the image forming apparatus of FIG. 2 in a warm-up state and a cleaning state, respectively, according to an example.
Figure 3B:
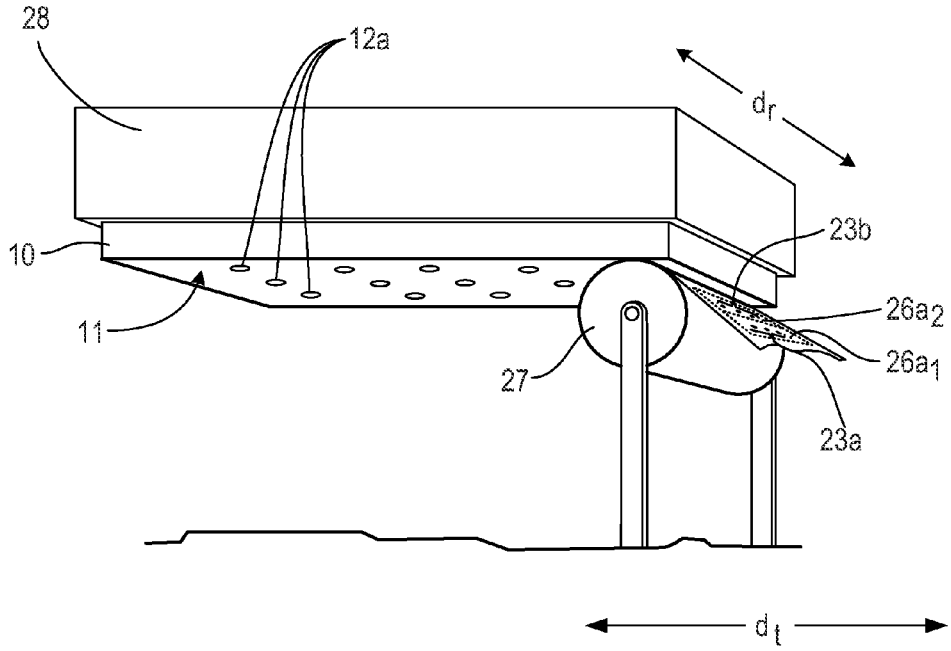

FIG. 2 is a perspective view illustrating the image forming apparatus of FIG. 1 according to an example. FIGS. 3A and 3B are side views illustrating portions of the image forming apparatus of FIG. 2 in a warm-up state and a cleaning state, respectively, according to examples. Referring to FIG. 2, in an example, the image forming apparatus 100 includes a fluid applicator unit 10, a drop detection unit 14, a detection receiving member 15 such as a spittoon 25, and a warm-up receiving member 16 such as a wiping member 26 as previously disclosed with respect to FIG. 1. As illustrated in FIG. 2, in examples, the image forming apparatus 100 may also include a movable wiper member 27, a movable carriage 28, and a movable service frame 29. The wiping member 26 includes a plurality of receiving portions 26$a_1$ and 26$a_2$ to receive the respective sets of warm-up fluid drops 23*a* and 23*b*. For example, the wiping member 23 may be fabric material supplied in a replaceable cartridge. The fabric material periodically moves in an advance direction $d_a$ by, for example, a pulling force and/or a pushing force. In the present example, not all sets of warm-up fluid drops are received on a same receiving portion 26$a_1$ and 26$a_2$ of the wiping member 26. That is, formulation of stalagmites by the accumulation of the warm-up fluid drops on the warm-up receiving member 16 is reduced by not having all sets of the warm-up fluid drops being received on top of each other on the warm-up receiving member 16.

Referring to FIGS. 2-3B, in examples, the movable wiper member 27 may be configured to selectively move the wiping member 26 and/or respective receiving portion 26$a_1$ and 26$a_2$ thereof to a predetermined location out of contact with the nozzle surface 11 to receive the sets of warm-up fluid drops 23*a* and 23*b* during a warm-up mode (FIG. 3A). In the warm-up mode, the placement of the respective receiving portion 26$a_1$ and 26$a_2$ of the wiping member 26 by the wiper member 27 may be upstream from the detection zone 14*a* with respect to an ejection direction $d_e$ of the detection fluid drops 23*c*. Such placement of the respective receiving portion 26$a_1$ and 26$a_2$ of the wiping member 26 proximate to the fluid applicator unit 10 may reduce an amount of aerosol created by the ejection of the respective sets of warm-up fluid drops 23*a* and 23*b*. The movable wiper member 27 may also be configured to selectively move the wiping member 26 in contact with the nozzle surface 11 of the fluid applicator unit 10 to wipe it during a cleaning mode (FIG. 3B). In an example, the movable wiper member 27 may selectively place the wiping member 26 in contact with the nozzle surface 11 after the warm-up receiving member 16 is moved in the advance direction $d_a$ with respect to the nozzles. Thus, a clean receiving portion will be used to contact and wipe the nozzle surface 11 of the fluid applicator unit 10.

As illustrated in FIG. 2, in the present example, the carriage 28 is configured to attach to and transport the fluid applicator unit 10 in a reciprocating direction $d_r$. In an example, the fluid applicator unit 10 may move to an image forming region $r_i$ in which image forming fluid drops are ejected onto a media to form images. The fluid applicator unit 10 may also move to a maintenance region $r_m$ in which detection fluid drops 23*c* and warm-up fluid drops 23*a* and 23*b* are ejected into respective receiving members 25 and 26 to maintain the fluid applicator unit 10. In the image forming region $r_i$, for example, the fluid applicator unit 10 may make multiple passes across a media to form images thereon. In the maintenance region $r_m$, for example, the movable service frame 29 is configured to move with respect to the fluid applicator unit 10 in a traverse direction $d_t$ to the reciprocating direction $d_r$. That is, the movable service frame 29 may move in a lengthwise direction with respect to the nozzle surface 11 of the fluid applicator unit 10. In an example, the fluid may include ink, the fluid applicator unit 10 may include an inkjet print head, and the image forming apparatus 10 may include an inkjet printer.

Referring to FIG. 2, the drop detection unit 14 is configured to establish the detection zone 14*a* and to detect detection fluid drops such as the first set of detection fluid drops 23*c* passing therein. The drop detection unit 14 may include a laser unit 14*b* to emit a beam such as an infrared beam to form the detection zone 14*a* and a sensor unit 14*c* to detect presence of a respective fluid drop passing into the beam such as detecting a change in intensity of the beam. In an example, the detection receiving member 15 (FIG. 1) such as a spittoon 25 is disposed downstream from the detection zone 14*a* with respect to the ejection direction $d_e$ of the detection fluid drops 23*c*. In an example, the wiper member 27, the wiping member 26, the drop detection unit 14 and the spittoon 25 are disposed on the movable service frame 29. Accordingly, each of the wiper member 27, the wiping member 26, the drop detection unit 14 including the detection zone 14*a* established thereby, and the spittoon 25 move with respect to the fluid applicator unit 10. Thus, in an example, the detection zone 14*a* may move across a predetermined area to intersect with previously ejected detection fluid drops 23*c* to detect their presence.

In the present example, at least one set of warm-up fluid drops ejected from a respective set of nozzles and at least one set of detection fluid drops ejected from a respective set of nozzles are both in flight at a same time during an overlapping time period. In an example, the overlapping time period may be a portion of the total time of flight of either the respective detection fluid drop or the respective warm-up fluid drop. For example, the total time of flight may correspond to the time that the respective fluid drop is ejected from the respective nozzle until the time in which the respective fluid drop lands on a respective receiving member 25 and 26. Thus, the ejection of a respective set of warm-up fluid drops 23*b* and a respective set of detection fluid drops 23*c* may proceed in a parallel manner, rather than in a serial manner, as each set of fluid drops 23*b* and 23*c* has a different flight path and are ejected from a different set of nozzles. That is, warm-up fluid drops 23*a* and 23*b* do not pass into the detection zone, whereas detection fluid drops 23*c* do pass into the detection zone 14*a*.

Figure 4:
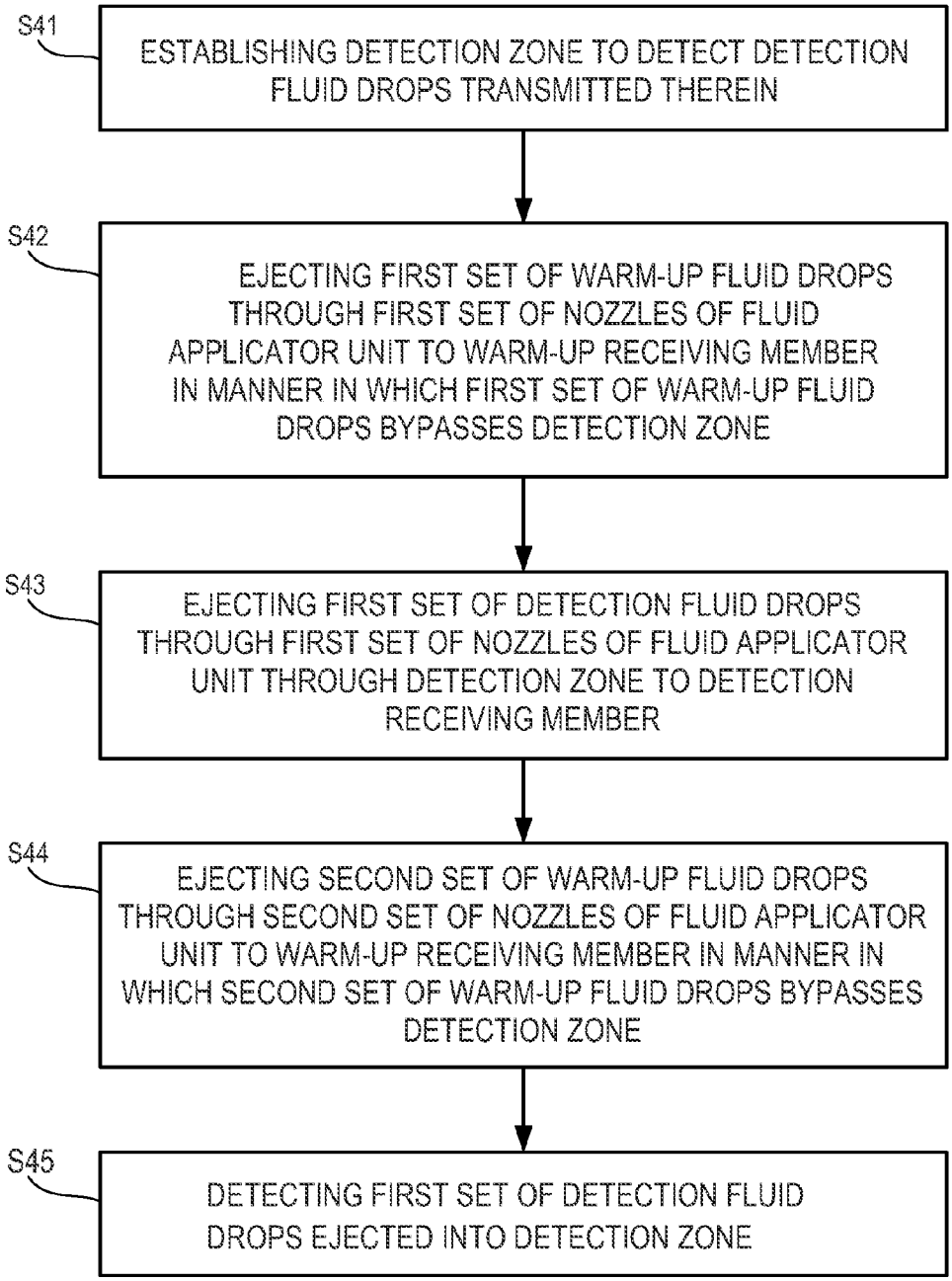
FIG. 4 is a flowchart illustrating a method of detecting fluid drops ejected from a fluid applicator unit having nozzles of an image forming apparatus according to an example.

FIG. 4 is a flowchart illustrating a method of detecting fluid drops ejected from a fluid applicator unit having nozzles of an image forming apparatus according to an example. Referring to FIG. 4, in block S41, a detection zone is established to detect detection fluid drops transmitted into the detection zone. In block S42, a first set of warm-up fluid drops is ejected through a first set of nozzles of a fluid applicator unit to a warm-up receiving member in a manner in which the first set of warm-up fluid drops bypasses the detection zone. In an example, the first set of warm-up fluid drops is ejected through the first set of nozzles before the first set of detection fluid drops is ejected through the first set of nozzles. In block S43, a first set of detection fluid drops is ejected through the first set of nozzles of the fluid applicator unit through the detection zone to a detection receiving member.

In block S44, a second set of warm-up fluid drops is ejected through a second set of nozzles of the fluid applicator unit to the warm-up receiving member in a manner in which the second set of warm-up fluid drops bypasses the detection zone. In an example, the second set of warm-up fluid drops ejected from the second set of nozzles and the first set of detection fluid drops ejected from the first set of nozzles are both in flight at a same time during an overlapping time period. In an example, the overlapping time period may be a portion of the total time of flight of either the respective detection fluid drop or the respective warm-up fluid drop. For example, the total time of flight may correspond to the time that the respective fluid drop is ejected from the respective nozzle until the time in which the respective fluid drop lands on a respective receiving member. In block S45, the first set of detection fluid drops ejected into the detection zone is detected.

In an example, the method may also include the warm-up receiving member being periodically moved in an advance direction with respect to the nozzles. The respective sets of warm-up fluid drops ejected from the respective sets of nozzles may be received by different receiving portions of the warm-up receiving member. The method may also include the warm-up receiving member being placed out of contact with the fluid applicator unit to receive the sets of warm-up fluid drops during a warm-up mode. The warm-up receiving member may also be placed in contact with the fluid applicator unit to wipe a nozzle surface thereof during a cleaning mode. The warm-up receiving member may be moved in an advance direction with respect to the nozzles prior to placing the warm-up receiving member in contact with the fluid applicator unit to wipe the nozzle surface thereof. In an example, each one of the detection zone and the fluid applicator unit independently move with respect to each other. For example, the fluid applicator unit may be moved by a carriage in a reciprocating direction. A drop detection unit with its corresponding detection zone formed thereby may be moved by a movable service frame in a traverse direction to the reciprocating direction.

Figure 5:
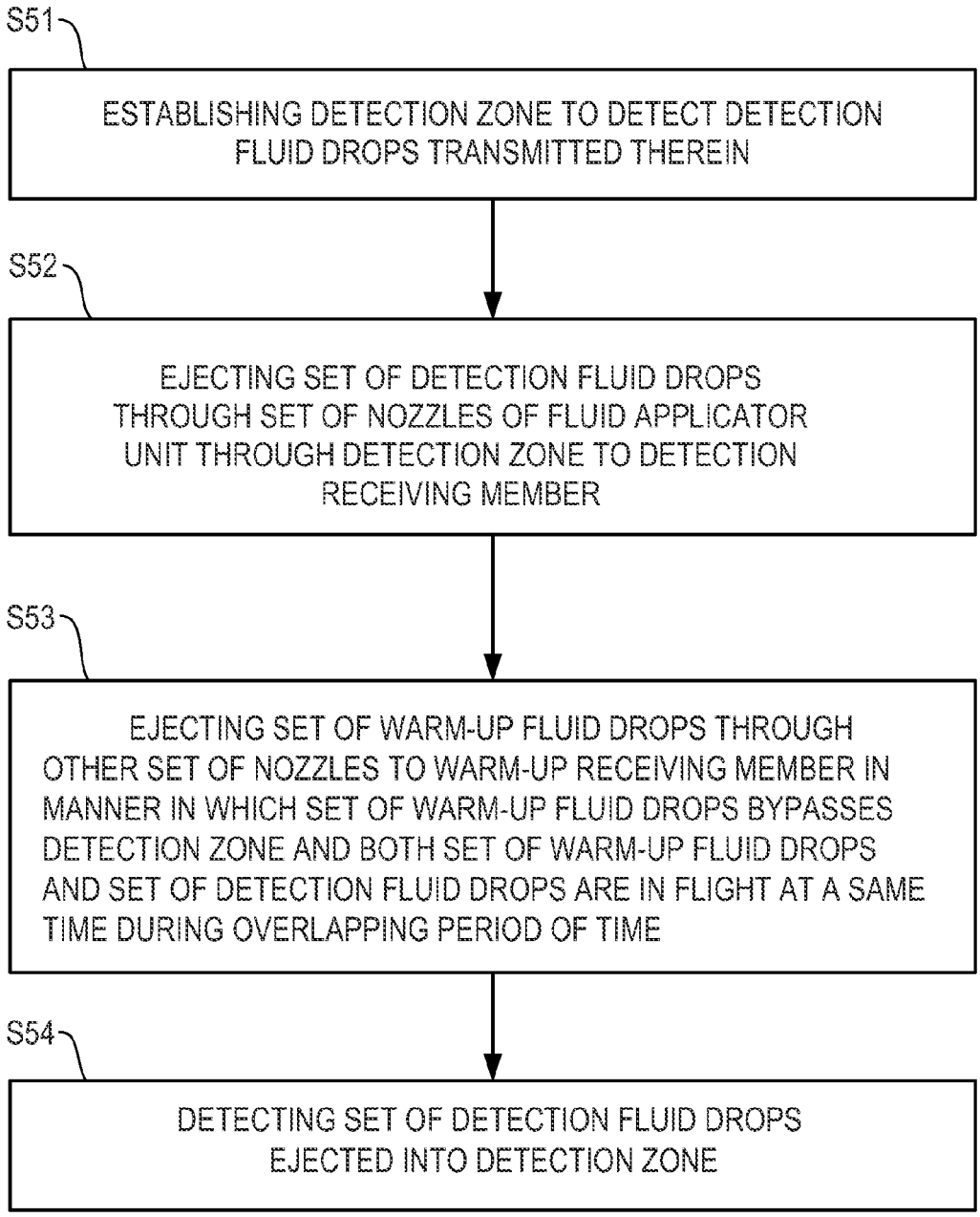
FIG. 5 is a flowchart illustrating a method of detecting fluid drops ejected from a fluid applicator unit having nozzles of an image forming apparatus according to an example.

FIG. 5 is a flowchart illustrating a method of detecting fluid drops ejected from a fluid applicator unit having nozzles of an image forming apparatus according to an example. Referring to FIG. 5, in block S51, a detection zone is established to detect detection fluid drops transmitted into the detection zone. In block S52, a set of detection fluid drops is ejected through a set of nozzles of the fluid applicator unit through the detection zone to a detection receiving member. In block S53, a set of warm-up fluid drops is ejected through an other set of nozzles to a warm-up receiving member in a manner in which the set of warm-up fluid drops bypasses the detection zone. Also, both the set of warm-up fluid drops and the set of detection fluid drops are in flight at a same time during an overlapping time period. In an example, the overlapping time period may be a portion of the total time of flight of either the respective detection fluid drop or the respective warm-up fluid drop. For example, the total time of flight may correspond to the time that the respective fluid drop is ejected from the respective nozzle until the time in which the respective fluid drop lands on a respective receiving member. In block S54, the set of the detection fluid drops ejected into the detection zone is detected.

In an example, the method may also include a previous set of warm-up fluid drops being ejected through the set of nozzles of the fluid applicator unit to the warm-up receiving member before the set of detection fluid drops is ejected through the set of nozzles. The method may also include the warm-up receiving member being moved with respect to the nozzles such that the previous set of warm-up fluid drops and the set of warm-up fluid drops are received by different receiving portions of the warm-up receiving member. The warm-up receiving member may be placed out of contact with the fluid applicator unit to receive the sets of warm-up fluid drops during a warm-up mode. That is, the warm-up receiving member may remain in or be moved into a non-contact state with the nozzle surface of the fluid applicator unit. The warm-up receiving member may be placed in contact with the fluid applicator unit to wipe a nozzle surface including the nozzles thereof during a cleaning mode. The warm-up receiving member may be placed in contact with the fluid applicator unit to wipe the nozzle surface thereof after the warm-up receiving member is moved in an advance direction with respect to the nozzles.

In an example, the set of warm-up fluid drops ejected from the other set of nozzles and the set of detection fluid drops ejected from the set of nozzles are both in flight at a same time during an overlapping time period. In an example, the overlapping time period may be a portion of the total time of flight of either the respective detection fluid drop or the respective warm-up fluid drop. For example, the total time of flight may correspond to the time that the respective fluid drop is ejected from the respective nozzle until the time in which the respective fluid drop lands on a respective receiving member. In an example, each one of the detection zone and the fluid applicator unit independently move with respect to each other. For example, the fluid applicator unit may be moved by a carriage in a reciprocating direction. A drop detection unit with its corresponding detection zone formed thereby may be moved by a movable service frame in a traverse direction to the reciprocating direction.

It is to be understood that the flowcharts of FIGS. 4 and 5 illustrate an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 4 and 5 illustrate a specific order of execution, the order of execution may differ from that which is depicted. For example, the order of execution of two or more blocks may be scrambled relative to the order illustrated. Also, two or more blocks illustrated in succession in FIGS. 4 and 5 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art.

Therefore, the scope of the present disclosure is limited only by the elements and limitations as used in the claims.

What is claimed is:

1. An image forming apparatus, comprising:

a fluid applicator unit including a nozzle surface having a plurality of sets of nozzles, the fluid applicator unit to eject a plurality of sets of warm-up fluid drops through a plurality of sets of nozzles and to eject a plurality of sets of detection fluid drops through the plurality of sets of nozzles;

a drop detection unit to establish a detection zone and to detect the plurality of sets of detection fluid drops transmitted therein;

a detection receiving member to receive the sets of detection fluid drops;

a receiving and wiping member including a plurality of receiving portions to periodically move in an advance direction with respect to the nozzles, one or more of the receiving portions to receive the sets of warm-up fluid drops such that not all of the plurality of sets of warm-up fluid drops are received on a same receiving portion, and another of the receiving portions to selectively contact and wipe the nozzle surface of the fluid applicator unit; and wherein the sets of detection fluid drops ejected from the fluid applicator unit pass into the detection zone and the sets of warm-up fluid drops ejected by the fluid applicator unit bypass the detection zone, wherein the receiving and wiping member comprises a length of fabric material, and the plurality of receiving portions comprise different segments of the length of fabric material.

2. The image forming apparatus according to claim 1, further comprising:

a movable wiper member to selectively place the one or more of the receiving portions of the receiving and wiping member to a predetermined location out of contact with the nozzle surface and upstream from the detection zone with respect to an ejection direction of the detection fluid drops to receive the sets of warm-up fluid drops during a warm-up mode, and to selectively place the another of the receiving portions of the receiving and wiping member in contact with the nozzle surface to wipe the nozzle surface during a cleaning mode.

3. The image forming apparatus according to claim 2, further comprising:

a movable carriage to removably attach to and transport the fluid applicator unit in a reciprocating direction; and a movable service frame to move with respect to the fluid applicator unit in a traverse direction with respect to the reciprocating direction.

4. The image forming apparatus according to claim 3, wherein the detection receiving member comprises:

a spittoon disposed downstream from the detection zone with respect to the ejection direction of the detection fluid drops.

5. The image forming apparatus according to claim 4, wherein the movable wiper member, the receiving and wiping member, the drop detection unit and the spittoon are disposed on the movable service frame such that each of the movable wiper member, the receiving and wiping member, the drop detection unit including the detection zone established thereby, and the spittoon move with respect to the fluid applicator unit.

6. The image forming apparatus according to claim 1, wherein at least one set of warm-up fluid drops ejected from a respective set of nozzles and at least one set of detection fluid drops ejected from a respective set of nozzles are both in flight at a same time during an overlapping time period.

7. The image forming apparatus according to claim 1, wherein the another of the receiving portions of the receiving and wiping member is placed in contact with the nozzle surface of the fluid applicator unit after the receiving portions of the receiving and wiping member are moved in the advance direction with respect to the nozzles.

8. An image forming apparatus, comprising:

a fluid applicator unit including a nozzle surface having nozzles;

a drop detection unit to detect detection fluid drops ejected from a set of the nozzles;

a drop detection receiving member to receive the detection fluid drops;

a receiving and wiping member including a plurality of receiving portions to periodically move in an advance direction with respect to the nozzles, at least one of the receiving portions to be selectively out of contact with the nozzle surface to receive warm-up fluid drops ejected from another set of the nozzles, and another of the receiving portions to be selectively in contact with the nozzle surface to wipe the nozzle surface; and the detection fluid drops to pass into a detection zone of the drop detection unit and the warm-up fluid drops to pass other than into the detection zone of the drop detection unit, wherein the another of the receiving portions of the receiving and wiping member is placed in contact with the nozzle surface of the fluid applicator unit after the receiving portions of the receiving and wiping member are moved in the advance direction with respect to the nozzles.

9. The image forming apparatus according to claim 8, wherein the receiving and wiping member comprises a length of fabric material, and the plurality of receiving portions comprise different segments of the length of fabric material.

10. The image forming apparatus according to claim 8, wherein the plurality of receiving portions comprise contiguous receiving portions.

11. The image forming apparatus according to claim 8, further comprising:

a movable member to selectively place the at least one of the receiving portions of the receiving and wiping member out of contact with the nozzle surface to receive the warm-up fluid drops during a warm-up mode, and to selectively place the another of the receiving portions of the receiving and wiping member in contact with the nozzle surface to wipe the nozzle surface during a cleaning mode;

a movable carriage to transport the fluid applicator unit in a reciprocating direction; and a movable service frame to support and move the movable member, the receiving and wiping member, the drop detection unit, and the drop detection receiving member with respect to the fluid applicator unit in a traverse direction with respect to the reciprocating direction.

12. The image forming apparatus according to claim 8, wherein the drop detection receiving member comprises a spittoon.

13. The image forming apparatus according to claim 8, wherein at least one set of warm-up fluid drops ejected from a respective set of the nozzles and at least one set of detection fluid drops ejected from a respective set of the nozzles are both in flight at a same time during an overlapping time period.

14. An image forming apparatus, comprising:

a fluid applicator unit including a nozzle surface having nozzles;

a drop detection unit to detect detection fluid drops ejected from a set of the nozzles;

a drop detection receiving member to receive the detection fluid drops;

a receiving and wiping member including a plurality of receiving portions to periodically move in an advance direction with respect to the nozzles, at least one of the receiving portions to be selectively out of contact with the nozzle surface to receive warm-up fluid drops ejected from another set of the nozzles, and another of the receiving portions to be selectively in contact with the nozzle surface to wipe the nozzle surface;

a movable member to selectively place the at least one of the receiving portions of the receiving and wiping member out of contact with the nozzle surface to receive the warm-up fluid drops during a warm-up mode, and to selectively place the another of the receiving portions of the receiving and wiping member in contact with the nozzle surface to wipe the nozzle surface during a cleaning mode;

a movable carriage to transport the fluid applicator unit in a reciprocating direction; and a movable service frame to support and move the movable member, the receiving and wiping member, the drop detection unit, and the drop detection receiving member with respect to the fluid applicator unit in a traverse direction with respect to the reciprocating direction, the detection fluid drops to pass into a detection zone of the drop detection unit and the warm-up fluid drops to pass other than into the detection zone of the drop detection unit.

15. The image forming apparatus according to claim 14, wherein the receiving and wiping member comprises a length of fabric material, and the plurality of receiving portions comprise different segments of the length of fabric material.

16. The image forming apparatus according to claim 14, wherein the another of the receiving portions of the receiving and wiping member is placed in contact with the nozzle surface of the fluid applicator unit after the receiving portions of the receiving and wiping member are moved in the advance direction with respect to the nozzles.

* * * * *